US010597827B2

(12) United States Patent
Ganz

(10) Patent No.: US 10,597,827 B2
(45) Date of Patent: Mar. 24, 2020

(54) MACHINE FOR REPAIRING A BALLAST BED WITH TWO SCREENING MACHINES, AND METHOD FOR REPAIRING A BALLAST BED

(71) Applicant: MATISA MATERIEL INDUSTRIEL S.A., Crissier (CH)

(72) Inventor: Joerg Ganz, Etoy (CH)

(73) Assignee: MATISA Materiel Industriel S.A., Crissier (CH)

( * ) Notice: Subject to any disclaimer, the term of this patent is extended or adjusted under 35 U.S.C. 154(b) by 0 days.

(21) Appl. No.: 16/085,669

(22) PCT Filed: Mar. 14, 2017

(86) PCT No.: PCT/IB2017/051457
§ 371 (c)(1),
(2) Date: Oct. 23, 2018

(87) PCT Pub. No.: WO2017/158500
PCT Pub. Date: Sep. 21, 2017

(65) Prior Publication Data

US 2019/0352855 A1 Nov. 21, 2019

(30) Foreign Application Priority Data

Mar. 15, 2016 (FR) ..... 16 52147

(51) Int. Cl.
*E01B 27/06* (2006.01)
*E01B 27/04* (2006.01)
*E01B 27/02* (2006.01)

(52) U.S. Cl.
CPC ..... *E01B 27/06* (2013.01); *E01B 27/022* (2013.01); *E01B 27/04* (2013.01); *E01B 2203/04* (2013.01)

(58) Field of Classification Search
CPC ..... E01B 27/026; E01B 27/06; E01B 27/10; E01B 27/105; E01B 2203/015;
(Continued)

(56) References Cited

U.S. PATENT DOCUMENTS 3,872,929 A * 3/1975 Teurer ..... E01B 27/02 171/16
4,257,331 A * 3/1981 Theurer ..... E01B 27/10 104/12
(Continued)

FOREIGN PATENT DOCUMENTS

EP 0408837 A1 1/1991
EP 1253247 B1 2/2005
(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

A machine for repairing a ballast bed has an undercutter that defines a direction of movement of the repairing machine, and a distributor for dividing a flow of ballast entering from the undercutter into a rear flow of exiting ballast and a separate front flow of exiting ballast. At least one rear screening machine is positioned behind the undercutter in the direction of movement and is fed by the rear flow of exiting ballast. At least one front screening machine is positioned in front of the undercutter and fed by the front flow of exiting ballast, and the distributor has a variator for varying the ratio between the separate first and the second flows of exiting ballast.

20 Claims, 2 Drawing Sheets

(58) Field of Classification Search
CPC ..... E01B 2203/022; E01B 2203/032; E01B 2203/04; E01B 2203/045; E01B 2203/065; E01B 2203/10; E01B 27/04
See application file for complete search history.

(56) References Cited

U.S. PATENT DOCUMENTS 4,430,944 A * 2/1984 Theurer ..... E01B 27/105 104/2
4,614,238 A 9/1986 Theurer et al.
4,770,104 A * 9/1988 Theurer ..... E01B 27/02 104/7.2
4,799,430 A * 1/1989 Theurer ..... E01B 27/105 104/2
4,813,488 A * 3/1989 Theurer ..... E01B 27/10 171/16
5,090,483 A 2/1992 Theurer et al.
5,172,636 A * 12/1992 Theurer ..... E01B 27/10 104/2
5,231,929 A * 8/1993 Theurer ..... E01B 27/10 104/2
5,394,944 A * 3/1995 Theurer ..... E01B 27/10 171/16
5,513,452 A * 5/1996 Theurer ..... E01B 27/10 104/2
5,611,403 A * 3/1997 Theurer ..... E01B 27/102 171/16
6,422,150 B2 * 7/2002 Theurer ..... E01B 27/08 104/2
6,619,405 B2 * 9/2003 Theurer ..... E01B 27/105 104/7.3
6,637,133 B2 * 10/2003 Theurer ..... E01B 27/105 104/7.1
6,672,398 B2 1/2004 Theurer et al.
9,157,194 B2 * 10/2015 Theurer ..... E01B 27/105
9,416,509 B2 * 8/2016 Theurer ..... E01H 8/00
10,266,991 B2 * 4/2019 Brunninger ..... E01B 27/10
2016/0312411 A1 10/2016 Brunninger

FOREIGN PATENT DOCUMENTS

FR 2539156 A1 7/1984
WO 2015106793 A1 7/2015

* cited by examiner

MACHINE FOR REPAIRING A BALLAST BED WITH TWO SCREENING MACHINES, AND METHOD FOR REPAIRING A BALLAST BED

TECHNICAL FIELD OF THE INVENTION

The invention relates to a machine for rehabilitating a ballast bed that moves by rolling on a railroad track.

PRIOR ART

Described in document FR 2 539 156 is a machine for rehabilitating a ballast bed that comprises an undercutter comprising an excavation tool that defines a direction of movement of the machine, a distributor for dividing an incoming ballast stream originating from the undercutter into two separate outgoing ballast streams, at least one front screening machine fed by a first of the two outgoing ballast streams; and at least one rear screening machine fed by a second of the two outgoing ballast streams. The two screening machines are positioned side-by-side, behind the undercutter in the direction of movement. The front screening machine supplies clean ballast to a front discharge chute positioned in the immediate vicinity of the undercutter. The rear screening machine supplies clean ballast to a discharge chute positioned behind the machine. Conveyors transport spoils to one or more storage cars, positioned at the very front of the rehabilitation machine, and in particular in front of the undercutter and the associated railroad track lifting tools. By dividing the stream originating from the undercutter into two parallel streams, the sizing of the screening machines is reduced. But the resulting machine is not more compact than if it were provided with a single screening machine. It furthermore requires a long path for transporting the spoils to the extreme front of the vehicle supporting the rehabilitation machine. It also requires a large-capacity conveyor for transporting the ballast from the undercutter to the screening machines. Furthermore, it is not provided with a store for the clean ballast resulting from the screening but that is surplus relative to the return-to-the-track ballast requirements. Neither is it provided with a path for transporting new ballast, should the clean ballast resulting from the screening be insufficient relative to the return-to-the-track requirements, which situation is encountered in particular in the initial and final operating phases of the machine.

SUMMARY OF THE INVENTION

The invention aims to overcome the drawbacks of the prior art and to propose a compact and versatile machine, that makes good use of the available space and that enables a simplified flow of the ballast.

In order to do this, a machine for rehabilitating a ballast bed is proposed, according to a first aspect of the invention, said machine comprising:

- at least one undercutter defining an operating movement direction of the rehabilitation machine,
- a distributor for dividing an incoming ballast stream originating from the undercutter into at least two separate outgoing ballast streams;
- at least one rear screening machine positioned behind the undercutter in the direction of movement and fed by a first of the separate outgoing ballast streams; and

- at least one front screening machine fed by a second of the separate outgoing ballast streams; and positioned in front of the undercutter.

By positioning the two screening machines on either side of the undercutter in the direction of movement, it is possible where appropriate to use the two ends of the machine to store, discharge or transport clean ballast or spoils, via the track that is being rehabilitated, or where appropriate via one or more parallel tracks.

To avoid storing clean ballast originating from the front screening machine, provision is made for the distributor to comprise a variator in order to vary the ratio between the first and second of the separate outgoing ballast streams. The control of the variator may be manual or automated, as a function of measured or estimated parameters, in an open loop or in a closed loop. The rehabilitation machine may in particular comprise means of controlling the flow rate of the second of the separate outgoing ballast streams as a function of a target reballasting ballast requirement flow rate, such that the flow rate of the second of the separate outgoing ballast streams is less than or equal to the target reballasting ballast requirement flow rate.

According to one preferred embodiment, the distributor is positioned between the rear screening machine and the front screening machine, preferably directly at the outlet of the undercutter. The distributor is thus in the vicinity of the undercutter, so that the distance to be travelled by the outgoing stream originating from the undercutter before the dividing thereof is minimized. The subsequent transporting of the ballast to the front and rear screening machines requires only a reduced flow rate relative to the outgoing stream, which enables a reduction in size of the transport paths to the screening machines. The first of the separate outgoing ballast streams, referred to as rear outgoing ballast stream, is transported to the rear and to the rear screening machine, whereas the second of the separate outgoing ballast streams, referred to as front outgoing ballast stream, is transported to the front and to the front screening machine.

The undercutter is positioned on an undercutter car. The front screening machine may be positioned preferably on the undercutter car, or where appropriate on a front screening car different from the undercutter car. The rear screening machine may itself be positioned on a rear screening car different from the undercutter car. This arrangement favors the modularity of the whole of the machine. Preferably, the distributor is placed on the undercutter car, the proximity between the distributor and the undercutter being, as has been said, favorable in terms of management of the ballast streams.

According to one embodiment, the machine for rehabilitating a ballast bed further comprises at least one front reballasting plow positioned behind the undercutter and a front reballasting conveyor for transporting clean ballast from the front screening machine to the front reballasting plow. The front screening machine is thus used in a favored manner for reballasting the track. Preferably, the front reballasting plow is positioned in the immediate vicinity of the undercutter, behind the undercutter. Specifically, the undercutter is always combined with a track lifting block which precedes it and enables it to work in the ballast bed under the lifted track. The front reballasting plow is intended to work, like the undercutter, in this portion of the work site where the track is raised. Preferably the front reballasting plow is positioned on the undercutter car. Where appropriate, the positioning of the reballasting plow may be adjustable, so as to move closer to or further away from the undercutter.

According to one embodiment, the machine for rehabilitating a ballast bed comprises a rear reballasting conveyor for transporting ballast suitable for use from back to front up to the front reballasting plow. This rear reballasting conveyor is especially useful when the front screening machine is shut down, or in order to supplement the production of the front screening machine. According to one embodiment, this rear reballasting conveyor may be fed by the rear screening machine. Alternatively or in combination, it may be fed by a reservoir of ballast suitable for use.

According to one embodiment, the machine for rehabilitating a ballast bed further comprises a bi-directional clean ballast conveyor for transporting clean ballast from the rear screening machine alternately to the front or to the back. This bi-directional conveyor thus allows at least two different uses of the clean ballast produced by the rear screening machine. According to one embodiment, a front end of the clean ballast conveyor feeds the rear reballasting conveyor.

According to one embodiment, the machine for rehabilitating a ballast bed further comprises a reservoir of ballast suitable for use, and one or more conveyors for transporting ballast suitable for use from the reservoir of ballast suitable for use to the ballast bed. The reservoir of ballast suitable for use may in particular be used as a reserve of new ballast, useful in particular at the start of a work sequence, when the undercutter penetrates into the ballast bed, or at the end of a work sequence, when the undercutter leaves the ballast bed. Preferably, the conveyor(s) make it possible to transport the ballast suitable for use to the front reballasting plow, or where appropriate to a rear reballasting plow.

Alternatively or in combination, the reservoir of ballast may be used as buffer storage for the excess clean ballast relative to the reballasting requirements. Specifically, the volume of clean ballast generated by treating the whole of the outgoing flow from the undercutter by the two screening machines is in general greater than the reballasting requirements, at least in the continuous operation phases outside of the start-up and shutdown sequences. Provision is therefore advantageously made for one end of the bi-directional clean ballast conveyor to discharge into the reservoir of ballast suitable for use.

A reservoir of ballast suitable for use may in particular be positioned between the undercutter and the rear screening machine or behind the ratio screening machine. By positioning the reservoir of ballast in the immediate vicinity of the front reballasting plow, the journey times of the ballast to the front reballasting plow, and therefore the response time of machine, are minimized. By choosing on the contrary to position the reservoir of ballast behind the rear storage machine, the conveyor from the distributor to the rear screening machine is short on. It is also possible to unhitch the car bearing the reservoir of ballast and to replace it.

It should be noted that it is possible, where appropriate, to dispense with storing a portion of the clean ballast originating from the front screening machine. Specifically, by controlling the front outgoing ballast stream that feeds the front screening machine, it is possible to quite accurately control the clean ballast stream leaving the front screening machine, and to limit the stream to that which is required. It is only in the case where the screening capacity of the front screening machine becomes insufficient to feed the reballasting plow (for example if the ballast originating from the undercutter is in poor condition and generates relatively little clean ballast and a lot of spoils) that the supplementary contribution of the ballast reservoir becomes necessary. In practice, this means that the rehabilitation machine does not comprise, or does not necessarily comprise, a front ballast reservoir in front of the undercutter. Provision may also be made for the rehabilitation machine to not comprise a conveyor of clean ballast from the front screening machine to the ballast reservoir, which is add additional simplification.

According to one embodiment, the machine for rehabilitating a ballast bed further comprises at least one rear reballasting plow positioned behind the undercutter and fed with clean ballast at least by the rear screening machine. When the machine has both a front reballasting plow and a rear reballasting plow, the function of the rear reballasting plow is first and foremost to distribute additional ballast on the track which already rests on the ballast bed reballasted by the front reballasting plow.

As a variant, and in particular in the case where the rehabilitation machine has no rear reballasting plow, it should be noted that it is possible to place the ballast reservoir in front of the undercutter, preferably between the undercutter and the front screening machine. In this case, the reballasting plow, located behind and in the vicinity of the undercutter, is fed first and foremost by the rear screening machine, a conveyor being provided between the ballast reservoir and the reballasting plow in order to provide an extra supply of clean ballast or of new ballast when this is necessary.

Preferably, the machine for rehabilitating a ballast bed further comprises at least one front spoils conveyor for transporting spoils leaving the front screening machine to at least one front spoils car to be positioned in front of the undercutter, and preferably in front of the front screening machine, or on an adjacent track. Similarly, the machine for rehabilitating a ballast bed further comprises at least one rear spoils conveyor for transporting spoils leaving the rear screening machine to at least one rear spoils car to be positioned behind the undercutter, and preferably behind the rear screening machine, or on an adjacent track.

According to one preferred embodiment, the undercutter has a given nominal ballast excavation capacity, and the front screening machine and the rear screening machine each have a nominal screening capacity strictly less than the nominal excavation capacity of the undercutter, preferably less than 80% of the nominal excavation capacity of the undercutter, and strictly greater than half of the nominal excavation capacity of the undercutter, preferably greater than 60% of the nominal excavation capacity of the undercutter. By ensuring a slight overall excess screening capacity, a judicious distribution of the screening between the front screening machine and the rear screening machine is facilitated. It further enables operation in a fail-soft mode, in the event of failure of one of the screening machines, or in economy mode, using only one screening machine when the undercutter is not operating at full capacity.

According to another embodiment, the undercutter has a given nominal ballast excavation capacity, and the front screening machine and the rear screening machine each have a nominal screening capacity greater than or equal to the nominal excavation capacity of the undercutter. This embodiment makes it possible, at the cost of a greater space requirement than the preceding embodiment, to work at full speed with only one of the two screening machines, which offers very great operating flexibility. It is then possible, for example, to discharge the spoils alternately via the two ends, which enables the rehabilitation machine to operate continuously: in one operating phase, the distributor sends the worn ballast stream to one of the screening machines and the spoils from the screening machine are discharged to the corresponding end of the rehabilitation machine where there is a spoils car. When this spoils car is full, the distributor diverts the whole of the worn ballast stream to the other screening machine and the spoils produced are discharged to the other end of the rehabilitation machine where there is another spoils car, which gives time to replace the full car at the first end with a new empty spoils car. The transition between the two phases is instantaneous, so that the replacement of the spoils car can be carried out without stopping the undercutter.

According to another aspect of the invention, the latter relates to a process for rehabilitating a ballast bed comprising:

- undercutting the ballast bed by means of at least one undercutter that moves relative to the ballast bed (12) in an operating movement direction,
- dividing a ballast stream originating from the undercutter into at least two separate outgoing ballast streams;
- carrying out a screening of a first of the separate outgoing ballast streams after the undercutting in the direction of movement; and
- carrying out a screening of a second of the separate outgoing ballast streams before the screening of the first of the separate outgoing ballast streams and before the undercutting in the direction of movement.

Preferably, the flow rate of the second of the separate outgoing ballast streams is varied as a function of a target reballasting ballast requirement flow rate, in such a way that the flow rate of the second of the separate outgoing ballast streams is less than or equal to the target reballasting ballast requirement flow rate.

Screening of the second of the separate outgoing ballast streams results in a front clean ballast stream and a front spoils stream. The front clean ballast stream is preferably completely retransported to the track in front of a front reballasting plow. The front spoils stream is preferably discharged via the front or sideways.

Screening of the first of the separate outgoing ballast streams results in a rear clean ballast stream and a rear spoils stream. According to embodiments of the process, the rear clean ballast stream can be at least partially stored in a ballast reservoir and/or at least partially retransported to the track, in front of a front reballasting plow and/or a rear reballasting plow. The rear spoils stream is preferably discharged via the rear or sideways.

BRIEF DESCRIPTION OF THE FIGURES

Other features and advantages of the invention will emerge on reading the following description, with reference to the appended figures, which illustrate.

For greater clarity, identical or similar elements are marked by identical reference signs in all of the figures.

DETAILED DESCRIPTION OF EMBODIMENTS

Figures 1A, 1B, 1C:
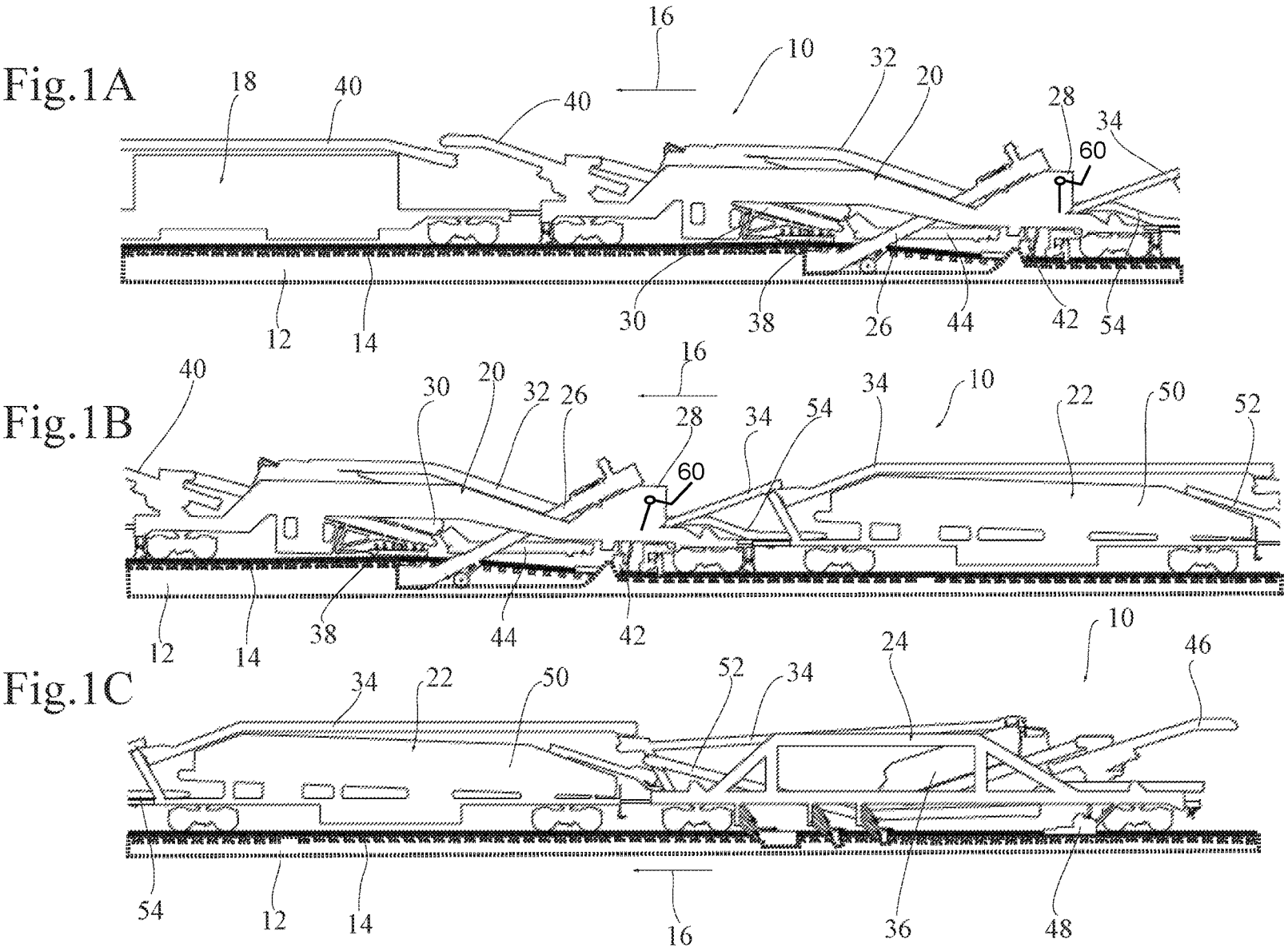
FIGS. 1A to 1C, a machine for rehabilitating a ballast bed according to a first embodiment of the invention.

Illustrated in FIGS. 1A to 1C is a machine 10 for rehabilitating a ballast bed 12 that is intended to move on a track 14 in the process of being rehabilitated in a direction of movement 16 from right to left in the figures. The rehabilitation machine is here composed of four cars 18, 20, 22, 24, the first two cars 18, 20 being illustrated in figure LA, the last two 22, 24 in FIG. 1C, FIG. 1B repeating the two intermediate cars 20, 22.

Within the context of the present description, the term car is used to denote a unit that rests on several undercarriages, in general a front bogie and a rear bogie, in order to move on the railroad track 14 in the process of being rehabilitated. Such a unit generally comprises a rigid chassis which supports the functional elements. Preferably, each car 18, 20, 22, 24 has its own bogies, different from the bogies of the adjacent cars, although the use of undercarriages shared by two adjacent cars can also be envisaged.

The first car, referred to as a power supply car 18, comprises the motors and hydraulic and/or pneumatic pumps necessary for powering the rehabilitation machine 10. It may also comprise a room for the staff, a control station, one or more tool stores or repair shops.

The second car, referred to subsequently as undercutter car 20, supports an undercutter 26, a distributor 28 and a front screening machine 30, positioned in front of the distributor 28 and in front of the undercutter 26.

The term "undercutter" denotes, in a known manner, a machine provided with an excavation tool that is positioned partially under the track and enables the excavation of the ballast. The tool may be formed by an endless chain that has a bottom part located constantly under the track, across the track, a top part driven by a motor, and side parts that follow two ramp paths of which one, which is ascending, makes it possible to transport the ballast from the bottom part to the top part, where it is discharged directly into the distributor 28.

The term "screening machine" covers any type of machine that enables a treatment of the worn ballast originating from the undercutter in order to extract therefrom or in order to produce a clean ballast capable of acting as reballasting for the track. This machine, well known to person skilled in the art, may particular comprise vibration generators and one or more stepped screens for treating the ballast and separating it from the spoils.

Figures 2A, 2B, 2C:
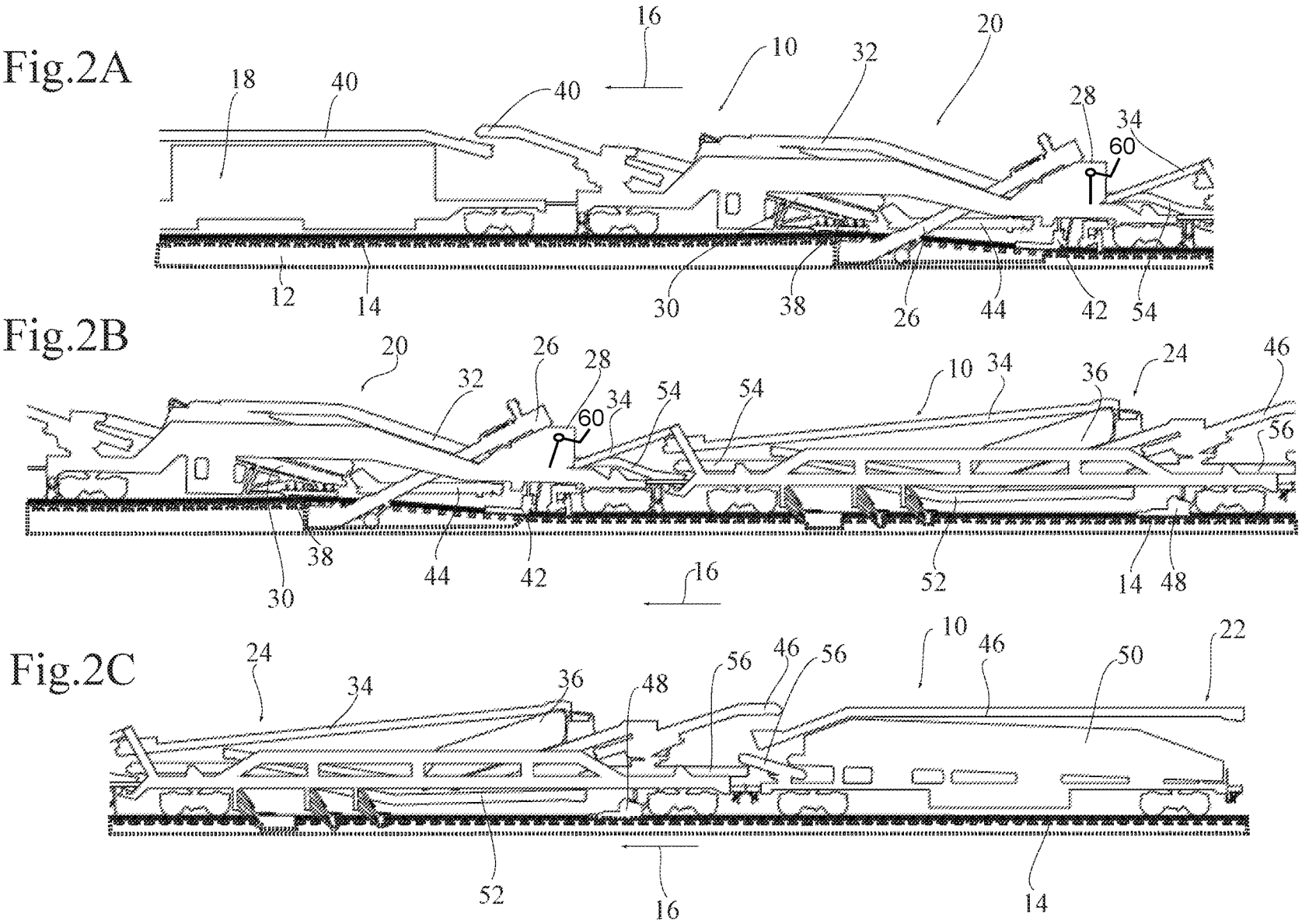
FIGS. 2A to 2C, a machine for rehabilitating a ballast bed according to a second embodiment of the invention.

The distributor 28 makes it possible to divide the incoming ballast stream originating from the undercutter 26 into two separate streams, namely a front outgoing ballast stream transported by a front worn ballast conveyor 32 to the front screening machine 30, and a rear outgoing ballast stream transported by a rear worn ballast conveyor 34 to the rear screening machine 36 positioned on the last car 24, referred to as rear screening car. The distributor 28 may be produced in various ways. It may for example be a top-fed tank having, in the bottom part, two outlets of which at least one, and preferably both, can be opened or closed by valves. It is also possible to have a single valve at the bottom of the tank, the variable positioning of which makes it possible to divide the incoming stream, in variable proportions, into two outgoing streams. The distributor 28 may also be formed by a first conveyor placed partially in the stream originating from the undercutter 26 and capturing only a portion of this stream, the other portion being recovered by a second conveyor placed below the first. The distributor preferably enables a variation of the dividing of the incoming stream into two separate outgoing streams. This capacity for variation may be continuous or incremental, and is preferably complete, in the sense that it preferably makes it possible to guide all of the incoming stream to the front worn ballast conveyor 32, or to the rear worn ballast conveyor 34, or in variable proportions (for example 80% to the front and 20% to the rear, or 50/50 or 20/80). Provision is made for the distributor 28 to comprise a variator 60 in order to vary the ratio between the first and second of the separate outgoing ballast streams. The control of the variator may be manual or automated. FIGS. 1A, 2A show the variator 60 sending more of the ballast to the rear worn ballast conveyor 34 than the front worn ballast conveyor 32 whereas FIGS. 1B, 2B show the variator sending more of the ballast to the front worn ballast conveyor 32.

A "conveyor" is understood to mean any type of conveying band, chain or belt, or more generally any device for continuous transport along a predefined path, in one or more sections, between two points of the rehabilitation machine 10, during the movement thereof. Such a conveyor may in particular comprise motorized parts and non-motorized parts, for example chute conveyors, for the parts where a gravity movement is possible. In the embodiment illustrated in FIGS. 1A to 1C, the front worn ballast conveyor 32 comprises a single bent section, or two rectilinear sections in the same rigid structure, since these two machines that it connects are located on the same car. The rear worn ballast conveyor 34, by contrast, comprises several sections, at least one car portion, which successively discharge one into the other. These conveyors are usually mobile and/or telescopic, to enable a high operational modularity. On passing from one car to another, one conveyor section generally discharges into another, and it may be necessary to make provision for one and/or the other of the sections to pivot about a vertical axis, in order to take into account positional variations of the cars with the curve of the track.

As is known, the undercutter 26 is combined with a track lifting block 38, located directly in front of the undercutter, and that makes it possible to raise the track at the location where the actual excavation by the undercutter 26 takes place.

The front screening machine 30 receives the front ballast stream transported by the front worn ballast conveyor 32 and treats the worn ballast in order to produce a clean ballast and spoils. A front spoils conveyor 40 transport the spoils leaving the front screening machine 30 two at least one front spoils car (not represented) positioned in front of the power supply car 18. The front spoils conveyor 40 may also be designed to pivot about a vertical axis, in order to feed, where appropriate, a spoils car located on a parallel track. The undercutter car 20 also supports a front reballasting plow 42 positioned at a distance from and behind the undercutter 26, and a front reballasting conveyor 44 for transporting the clean ballast leaving the front screening machine 30 to the track 14, in front of or level with the front reballasting plow 42 and behind the undercutter 26. The role of the front reballasting plow 42 is to distribute the ballast suitable for use, that is to say either clean ballast, or new ballast, in the cavity produced by the undercutter, before resting the track on the ballast thus distributed. The front reballasting plow must therefore be in a part of the work site relatively close to the track lifting block 38.

The rear screening machine 36, positioned on the fourth car 24, referred to as rear screening car, receives the worn ballast transported by the rear worn ballast conveyor 34 and treats the worn ballast in order to produce clean ballast and spoils. A rear spoils conveyor 46 transports the spoils leaving the rear screening machine 36 to a rear spoils car (not represented) positioned behind the rehabilitation machine 10. The rear spoils conveyor 46 may also be designed to pivot about a vertical axis, in order to feed, where appropriate, a spoils car located on a parallel track.

The rear screening car 24 also supports a rear reballasting plow 48 fed with clean ballast by the rear screening machine 36. The rear reballasting plow 48 is intended to distribute ballast suitable for use laterally on either side of the track and between the ties in a section of the work site where the track already rests on the ballast suitable for use spread by the front reballasting plow 42.

Positioned between the undercutter car 20 and the rear screening car 24 is the third car, referred to as storage car 22, which essentially comprises a reservoir of ballast suitable for use 50.

The clean ballast produced by the rear screening machine 36 is itself collected by a bi-directional rear clean ballast conveyor 52, which in an operating direction (toward the rear) makes it possible to feed the rear reballasting plow 48, and in the opposite direction (toward the front) makes it possible to feed the reservoir of ballast suitable for use 50. A rear reballasting conveyor 54 makes it possible to transport, if necessary, ballast present in the storage car 22 to the front reballasting plow 42.

Remarkably, there is no reservoir of ballast suitable for use in front of the undercutter 26 and, at least under normal usage conditions, the front screening machine 30 does not feed the reservoir of ballast suitable for use 50 located behind the undercutter 26.

Specifically, the rehabilitation machine 10 is designed so that all the clean ballast produced by the front screening machine 30 is directly transported to the front reballasting plow 42, without intermediate storage. As was disclosed above, the total volume of clean ballast produced by the two screening machines 30, 36 is usually greater than the ballast requirements at the front reballasting plow 42. But it is possible to limit the production of clean ballast by the front screening machine 30 so that it is never greater than the requirements, by limiting the stream of worn ballast to the front screening machine 30. The control of the clean ballast produced by the front screening machine 30 is therefore essentially achieved by modifying, at the distributor 28, the proportion of the worn ballast sent to the front screening machine 30. The excess worn ballast excavated by the undercutter 26 and which is not sent to the front screening machine 30 is sent to the rear screening machine 36 which feeds the rear reballasting plow 48 and/or the reservoir of ballast suitable for use 50. In operating phases where the production of clean ballast by the front screening machine 30 becomes insufficient (either due to a malfunction of the front screening machine 30, or due to the nature or amount of the ballast excavated by the undercutter 26), the missing amount of ballast is fed from the reservoir of ballast suitable for use 50 to the track 12 level with the front reballasting plow 42 by the rear reballasting conveyor 34.

The means of controlling the distributor 28 May include means of estimating the volume, the mass and/or the flow rate of reballasting ballast needed at the front reballasting plow 42. They may also include means of measuring or estimating a degree of opening of a distribution valve of the distributor 28 or the amount (mass, volume and/or flow rate) of worn ballast transported to the front screening machine 30. They may also include means of measuring the power, energy, speed or other quantity that are characteristic of the operation of the front screening machine 30. They may also include means of measuring or estimating the amount (mass, volume and/or flow rate) of worn ballast produced by the front screening machine 30, or present on the front reballasting conveyor 44 connecting the front screening machine 30 to the front reballasting plow 42. The distributor 28 may also be controlled, using given setpoint values, manually from a control station.

It is understood that under normal usage conditions, the excavated ballast stream originating from the undercutter 26 is designed to always be shared between the front screening machine 30 and the rear screening machine 36, so that it is not necessary that the screening machines 30, 36 can individually absorb the entire stream originating from the undercutter 26. The front screening machine 30 and the rear screening machine 36 therefore preferably each have a nominal screening capacity strictly less than the nominal excavation capacity of the undercutter 26, preferably less than 80% of the nominal excavation capacity of the undercutter 26, and strictly greater than half of the nominal excavation capacity of the undercutter 36, preferably greater than 60% of the nominal excavation capacity of the undercutter. In the event of failure of one of the screening machines 30, 36 the rehabilitation machine 10 may also operate in fail-soft mode at reduced speed.

Although the size of the screening machines 30, 36 is not a limiting criterion, provision may also be made for each screening machine 30, 36 or at least one of them, preferably the front screening machine 30, have a nominal screening capacity at least equal to the nominal excavation capacity of the undercutter 26. In such a case, the rehabilitation machine 10 may operate at its nominal excavation rate by sending the entire stream to only one of the screening machines 30, 36. The rehabilitation machine may thus operate at its nominal rate by sending the entire spoils optionally to the front or to the rear, which makes it possible to adapt very freely to the constraints of the work site according to whether it is easier to move the spoils cars in front of or behind the rehabilitation machine 10. This sizing of the screening machines 30, 36 also makes it possible to not interrupt the excavation when a spoils car at one end of the rehabilitation machine is full and when it is necessary to replace it with another. Specifically, it is impossible to momentarily transfer the entire stream of worn ballast to the other screening machine and the other end of the rehabilitation machine 10, at least for the time for changing the spoils wagon.

The embodiment from FIGS. 2A to 2C differs from the preceding embodiment in particular by the positioning of the reservoir of ballast suitable for use 50, and of the storage car 22 that bears it. Specifically, the reservoir of ballast suitable for use 50 is positioned behind the rear screening machine 36 and, consequently, the storage car 22 is positioned at a distance from the front reballasting plow 42, which shortens the rear worn ballast conveyor 34 but lengthens the rear spoils conveyor 46 between the reservoir of ballast suitable for use 50 and the front reballasting plow 42. The clean ballast conveyor 52 which directly connects the clean ballast produced by the rear screening machine 36 is bi-directional. When it is driven in a first direction (toward the front), the clean ballast conveyor 52 discharges via its front end into rear reballasting conveyor 54 which feeds the front reballasting plow 42. When it is fed in the opposite direction (toward the rear) the clean ballast conveyor 52 discharges via its rear end level with the rear reballasting plow 48. Is not designed to transport a surplus of clean ballast to the reservoir of ballast suitable for use 50, which consequently only contains new ballast. A new ballast conveyor 56 is placed directly at the outlet of the reservoir of ballast suitable for use 50, which makes it possible, by opening the reservoir of ballast suitable for use 50, to feed new ballast to the rear reballasting plow 48 and/or the front reballasting plow 42, where appropriate in addition to the clean ballast originating from the rear screening machine 36.

Naturally, and as a person skilled in the art will easily understand, this rehabilitation machine 10 may be supplemented with additional cars, in order to add functions thereto, where appropriate.

Various modifications can be envisaged. In particular, the distribution of the various elements of the rehabilitation machine over the various cars may vary. For example, the front screening machine may be placed on a front screening car separate from the undercutter car, in front thereof.

Naturally, the examples represented in the figures and discussed above are given solely by way of nonlimiting illustration. It is explicitly anticipated that the various embodiments illustrated can be combined together to propose other embodiments.

It is emphasized that all the features, as they emerge for a person skilled in the art from the disclosure of the application, even if in concrete terms they have only been described in connection with other determined features, individually as well as in any combinations, may be combined with other features or groups of features disclosed here, provided that this is not expressly excluded or that technical circumstances do not render such combinations impossible or devoid of meaning.

The invention claimed is:

1. A machine for rehabilitating a ballast bed comprising:
- at least one undercutter defining an operating movement direction of the machine;
- a distributor for dividing an incoming ballast stream originating from said undercutter into at least two separate outgoing ballast streams;
- at least one rear screening machine positioned behind said undercutter in a direction of movement and fed by a first of the two separate outgoing ballast streams;
- at least one front screening machine fed by a second of the two separate outgoing ballast streams, said front screening machine is positioned in front of said undercutter; and
- said distributor having a variator for varying a ratio between the first and second of the two separate outgoing ballast streams.

2. The machine for rehabilitating the ballast bed according to claim 1, wherein said distributor is positioned between said rear screening machine and said front screening machine.

3. The machine for rehabilitating the ballast bed according to claim 2, wherein:
- said undercutter has an outlet; and
- said distributor is positioned directly at said outlet of said undercutter.

4. The machine for rehabilitating the ballast bed according to claim 1,
- further comprising a rear screening car;
- further comprising an undercutter car and said undercutter is positioned on said undercutter car; and
- wherein at least one of the following conditions is met:
  - said front screening machine is positioned on said undercutter car;
  - said rear screening machine is positioned on said rear screening car different from said undercutter car; and
  - said distributor is placed on said undercutter car.

5. The machine for rehabilitating the ballast bed according to claim 1, further comprising:
- at least one front reballasting plow disposed behind said undercutter; and
- a front reballasting conveyor for transporting clean ballast from said front screening machine to said front reballasting plow.

6. The machine for rehabilitating the ballast bed according to claim 5, further comprising a rear reballasting conveyor for transporting ballast suitable for use from back to front, up to said front reballasting plow.

7. The machine for rehabilitating the ballast bed according to claim 6, further comprising a bi-directional clean ballast conveyor for transporting clean ballast from said rear screening machine alternately to the front or to the back.

8. The machine for rehabilitating the ballast bed according to claim 7, wherein said bi-directional clean ballast conveyor has a front end that feeds said rear reballasting conveyor.

9. The machine for rehabilitating the ballast bed according to claim 1, further comprising:

a reservoir for storing ballast suitable for use; and at least one conveyor for transporting the ballast suitable for use from said reservoir to the ballast bed.

10. The machine for rehabilitating the ballast bed according claim 9, wherein one end of said conveyor being a bi-directional clean ballast conveyor discharges into said reservoir for storing the ballast suitable for use.

11. The machine for rehabilitating the ballast bed according to claim 1, further comprising at least one rear reballasting plow positioned behind said undercutter and fed with clean ballast at least by said rear screening machine.

12. The machine for rehabilitating the ballast bed according to claim 1, further comprising at least one front spoils conveyor for transporting spoils leaving said front screening machine to at least one front spoils car to be positioned in front of said undercutter.

13. The machine for rehabilitating the ballast bed according to claim 12, wherein said at least one front spoils conveyor is disposed in front of said front screening machine or on an adjacent track.

14. The machine for rehabilitating the ballast bed according to claim 1, further comprising at least one rear spoils conveyor for transporting spoils leaving said rear screening machine to at least one rear spoils car to be positioned behind said undercutter.

15. The machine for rehabilitating the ballast bed according to claim 14, wherein said at least one rear spoils conveyor is disposed behind said rear screening machine, or on an adjacent track.

16. The machine for rehabilitating the ballast bed according to claim 1, wherein:

said undercutter has a given nominal ballast excavation capacity; and said front screening machine and said rear screening machine each have a nominal screening capacity strictly less than the given nominal ballast excavation capacity of said undercutter, and strictly greater than half of the given nominal ballast excavation capacity of said undercutter.

17. The machine for rehabilitating the ballast bed according to claim 1, wherein said undercutter has a given nominal ballast excavation capacity, and said front screening machine and said rear screening machine each have a nominal screening capacity greater than or equal to the given nominal excavation capacity of said undercutter.

18. The machine for rehabilitating the ballast bed according to claim 1, wherein:

said undercutter has a given nominal ballast excavation capacity; and said front screening machine and said rear screening machine each have a nominal screening capacity less than 80% of the given nominal ballast excavation capacity of said undercutter, and strictly greater than 60% of the given nominal ballast excavation capacity of said undercutter.

19. A process for rehabilitating a ballast bed comprising:

undercutting the ballast bed by means of at least one undercutter that moves relative to the ballast bed in an operating direction of movement;

dividing a ballast stream originating from the undercutter into at least two separate outgoing ballast streams;

carrying out a screening of a first of the two separate outgoing ballast streams after the undercutting in the operating direction of movement; and carrying out a screening of a second of the two separate outgoing ballast streams before the screening of the first of the two separate outgoing ballast streams, the screening of the second of the two separate outgoing ballast streams is carried out before the undercutting in the operating direction of movement, the dividing making it possible to vary a ratio between the first and the second of the separate outgoing ballast streams.

20. The process for rehabilitating the ballast bed according to claim 19, which further comprises varying a flow rate of the second of the two separate outgoing ballast streams in dependence on a target reballasting ballast requirement flow rate, in such a way that a flow rate of the second of the two separate outgoing ballast streams is less than or equal to the target reballasting ballast requirement flow rate.

* * * * *